US009527283B2

(12) United States Patent
Hirai et al.

(10) Patent No.: US 9,527,283 B2
(45) Date of Patent: Dec. 27, 2016

(54) LIQUID EJECTION HEAD AND LIQUID EJECTION APPARATUS

(71) Applicant: SEIKO EPSON CORPORATION, Tokyo (JP)

(72) Inventors: Eiju Hirai, Minowa-machi (JP); Toshiaki Hamaguchi, Fujimi-machi (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/970,928

(22) Filed: Dec. 16, 2015

(65) Prior Publication Data

US 2016/0221340 A1 Aug. 4, 2016

(30) Foreign Application Priority Data

Jan. 29, 2015 (JP) ..... 2015-015218

(51) Int. Cl.
*B41J 2/14* (2006.01)

(52) U.S. Cl.
CPC ..... *B41J 2/14233* (2013.01); *B41J 2/14201* (2013.01); *B41J 2/14274* (2013.01); *B41J 2002/14491* (2013.01)

(58) Field of Classification Search
CPC ..... B41J 2/14201; B41J 2/14233; B41J 2002/14241; B41J 2/14274; B41J 2002/14306; B41J 2002/14491; H01L 41/047;H01L 41/0475; H01L 41/0478; H01L 41/0477
See application file for complete search history.

(56) References Cited

U.S. PATENT DOCUMENTS 6,336,717 B1 * 1/2002 Shimada ..... B41J 2/14233 347/71
6,502,928 B1 1/2003 Shimada et al.

FOREIGN PATENT DOCUMENTS

JP 3114808 B 9/2000
JP 2014-083797 A 5/2014

* cited by examiner

*Primary Examiner* — Geoffrey Mruk
(74) *Attorney, Agent, or Firm* — Workman Nydegger

(57) ABSTRACT

A liquid ejection head includes a vibration portion that serves as a wall of a pressure chamber having a shape extending in a first direction; at least one piezoelectric element that is disposed on the vibration portion at an opposite side to the pressure chamber; and an extracting portion that electrically connects the piezoelectric element to external wiring. The piezoelectric element includes a first electrode, a second electrode, and a piezoelectric material layer between the first electrode and the second electrode. In a plan view, the first electrode has a planar shape that is included in shapes of the second electrode and the pressure chamber, and the extracting portion protrudes from a peripheral edge of the first electrode so as to cross a long side of an inner peripheral edge extending in the first direction of the pressure chamber.

14 Claims, 11 Drawing Sheets

LIQUID EJECTION HEAD AND LIQUID EJECTION APPARATUS

BACKGROUND

1. Technical Field

The present invention relates to a technique for ejecting liquid, such as ink, by utilizing a piezoelectric element.

2. Related Art

Heretofore, there has been proposed a liquid ejection head having a structure that allows liquid inside each of a plurality of pressure chambers thereof to be ejected through a nozzle by allowing a piezoelectric element associated with the relevant pressure chamber to vibrate a vibration plate constituting a wall of the relevant pressure chamber. For example, in JP-A-2014-83797, there is disclosed a piezoelectric element in which a piezoelectric material layer is formed between a first electrode that is individually formed for each of a plurality of piezoelectric elements and a second electrode that is formed across the plurality of piezoelectric elements. The first electrode, which is linearly formed along a corresponding pressure chamber, extends up to the outside of the pressure chamber in a plan view (that is, the first electrode crosses a short side of the pressure chamber in a plan view), and an edge on the extended side of the first electrode is electrically connected to external wiring. Japanese Patent No. 3,114,808 is also an example of related art.

In the piezoelectric material layer, stress is likely to arise at the boundary between a region that is deformed due to a piezoelectric effect in accordance with electric field between the first electrode and the second electrode (hereinafter, this region will be referred to as "a movable portion") and a non-movable portion other than the relevant movable portion. Meanwhile, in a vibration plate, a region along the short side of the pressure chamber is less likely to be deformed than a region along a long side of the pressure chamber. In the configuration disclosed in JP-A-2014-83797, since the first electrode is formed so as to cross the short side of the pressure chamber in a plan view, a deformation, which occurs in the piezoelectric material layer due to the stress that arises in a region close to the boundary between the movable portion and the non-movable portion, is suppressed by the vibration plate and, as a result, the piezoelectric material layer is likely to be broken (burned out).

SUMMARY

An advantage of some aspects of the invention is that a liquid ejection head and a liquid ejection apparatus are provided, which enable prevention of the breakage of a piezoelectric material layer of a piezoelectric element.

According to a first aspect of the invention, a liquid ejection head includes a vibration portion that serves as a wall of a pressure chamber having a shape extending in a first direction, at least one piezoelectric element that is disposed on the vibration portion at an opposite side to the pressure chamber, and an extracting portion that electrically connects the piezoelectric element to external wiring. The piezoelectric element includes a first electrode, a second electrode, and a piezoelectric material layer between the first electrode and the second electrode. Further, in a plan view, the first electrode has a planar shape that is included in shapes of the second electrode and the pressure chamber, and, the extracting portion protrudes from a peripheral edge of the first electrode so as to cross a long side of an inner peripheral edge extending in the first direction of the pressure chamber.

In the piezoelectric material layer, stress is likely to arise at the boundary between a movable portion capable of being deformed due to electric field behavior between the first electrode and the second electrode and a non-movable portion other than the movable portion. Meanwhile, a region constituting the vibration portion and being close to the long side of the pressure chamber is easier to be deformed as compared with a region constituting the vibration portion and being close to a short side of the pressure chamber. In the liquid ejection head according to the first aspect of the invention, the extracting portion, which electrically connects the piezoelectric element to external wiring, is formed so as to cross the long side of the pressure chamber in a plan view. Thus, stress that arises in a region constituting the piezoelectric material layer and corresponding to the extracting portion is more likely to be absorbed or dispersed as compared with a configuration in which the extracting portion is formed so as to cross a short side of the pressure chamber in a plan view and, as a result, there is an advantage in that the breakage of the piezoelectric material layer can be prevented.

In addition, in a configuration in which a portion of the first electrode does not overlap the second electrode in a plan view, a region constituting the piezoelectric material layer and corresponding to the relevant portion of the first electrode does not function as the movable portion. In the configuration of the liquid ejection head according to the first aspect of the invention, the first electrode is included in the inside of the second electrode in a plan view, and thus, a movable portion having a shape across the entire region of the first electrode in a plan view is defined. In this way, a region large enough as the movable portion is secured in the piezoelectric material layer and, as a result, there is also an advantage in that it becomes easier to vibrate the vibration portion.

In the liquid ejection head according to the aspect of the invention, it is preferable that the at least one piezoelectric element comprise a plurality of piezoelectric elements that are arranged in a second direction intersecting the first direction. In this aspect, there is an advantage in that the breakage of the piezoelectric material layer of the plurality of piezoelectric elements can be prevented.

In the liquid ejection head including the plurality of piezoelectric elements, it is preferable that the first electrode and the second electrode be individual electrodes that are formed for each of the plurality of piezoelectric elements, and the first electrode that is formed for each of the plurality of piezoelectric elements be electrically connected to a common wire via the extracting portion. In this aspect, a common signal (for example, a reference voltage) is supplied from the common wire to each of a plurality of the first electrodes via the extracting portion while a driving signal (for example, a driving voltage) is individually supplied to each of a plurality of the second electrodes, thereby enabling each of the piezoelectric elements to be individually controlled.

In the liquid ejection head including the plurality of piezoelectric elements, it is preferable that a relay wire that is electrically connected to the common wire be formed for a pair of a first piezoelectric element and a second piezoelectric element that constitute the plurality of piezoelectric elements and that are arranged in the second direction so as to be adjacent to each other, and the extracting portion of the first piezoelectric element and the extracting portion of the second piezoelectric element be electrically connected in common to a relay wire corresponding to the pair. In this aspect, the first piezoelectric element and the second piezoelectric element, which are arranged in the second direction so as to be adjacent to each other, are electrically connected in common to the relay wire, and thus, there is an advantage in that a space required to form wiring for connecting each of the plurality of piezoelectric elements to external wiring is made small as compared with a configuration in which a relay wire is individually formed for each of the plurality of piezoelectric elements, and consequently, the downsizing of the liquid ejection head can be achieved.

In the liquid ejection head including the plurality of piezoelectric elements, it is preferable that the first electrode be an individual electrode that is individually formed for each of the plurality of piezoelectric elements, and the second electrode be a common electrode that extends over the plurality of piezoelectric elements. In this aspect, a driving signal (for example, a driving voltage) is individually supplied from external wiring to each of the plurality of first electrodes via the extracting portion, thereby enabling each of the piezoelectric elements to be individually controlled. At the same time, the second electrode is a common electrode that extends over the plurality of piezoelectric elements, and thus, there is an advantage in that a process of forming the second electrode is made simple and the resistance of the second electrode is made small, as compared with a configuration in which the second electrode is individually formed for each of the piezoelectric elements.

In the liquid ejection head according to the aspect of the invention, it is preferable that the piezoelectric material layer extend and serve as the plurality of piezoelectric elements, and a slit that is long in the first direction be formed between two adjacent piezoelectric elements of the plurality of piezoelectric elements arranged in a second direction intersecting the first direction, and the extracting portion be disposed at one side of the slit in the first direction. In this aspect, the extracting portion is disposed at one side of the slit in the first direction (that is, the extracting portion does not overlap the slit in a plan view), and thus, there is an advantage in that it is possible to prevent the occurrence of a failure (for example, a breakage of the extracting portion due to an exposure of the extracting portion through the inside of the slit) due to a configuration in which the extracting portion overlaps the slit in a plan view.

According to a second aspect of the invention, a liquid ejection apparatus includes the liquid ejection head according to any one of the above aspects of the invention. A preferred application example of the liquid ejection head is a printing apparatus that ejects ink, but the intended use of the liquid ejection apparatus according to this aspect of the invention is not limited to printing.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Figure 1:
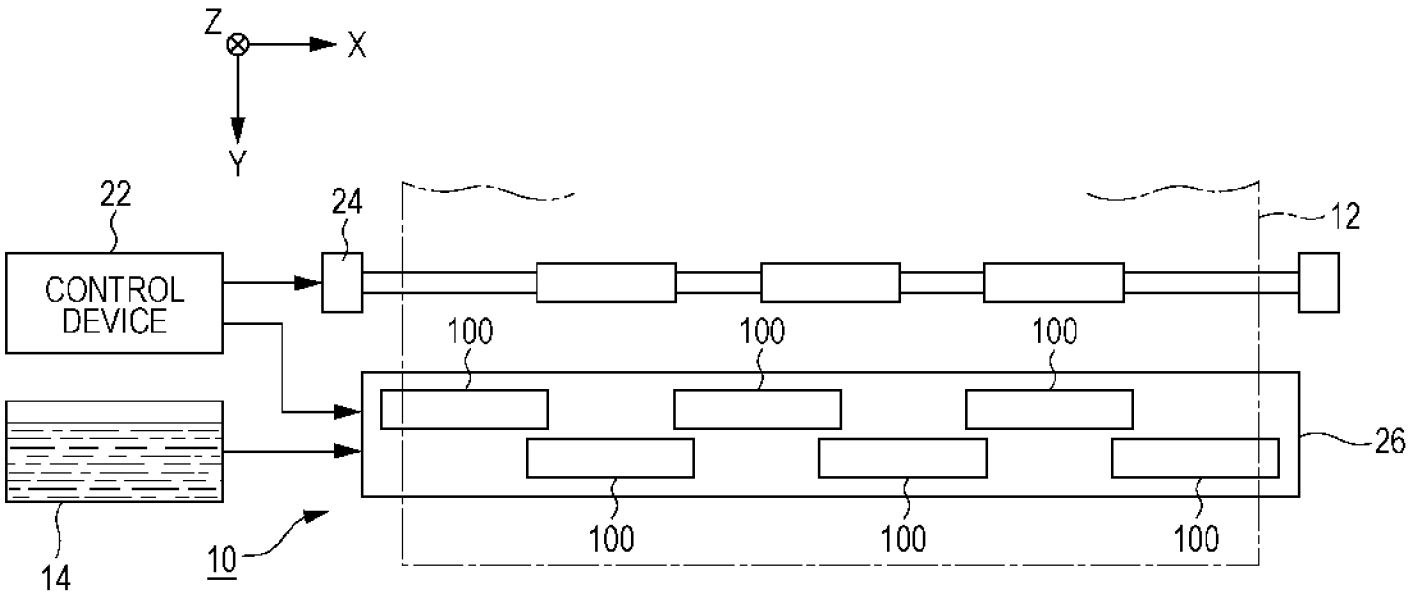
FIG. 1 is a diagram illustrating a configuration of a printing apparatus according to a first embodiment of the invention.

FIG. 1 is a diagram illustrating a partial configuration of an ink jet type printing apparatus 10 according to a first embodiment of the invention. This printing apparatus 10 is a specific example of a liquid ejection apparatus that ejects ink, which is an example of liquid, onto a medium (ejection target), such as a print paper, and includes a control device 22, a transport mechanism 24, and a liquid ejection module 26. A liquid container (cartridge) 14 storing the ink is attached to the printing apparatus 10.

The control device 22 comprehensively controls individual components of the printing apparatus 10. The transport mechanism 24 transports the medium 12 under the control of the control device 22. The liquid ejection module 26 includes a plurality of liquid ejection heads 100. The liquid ejection module 26 of the first embodiment is a line head having a structure in which the plurality of liquid ejection heads 100 are disposed (in a so-called zigzag arrangement or staggered arrangement) in an X direction perpendicular to a Y direction. The liquid ejection heads 100 eject the ink supplied from the liquid container 14 onto the medium 12 under the control of the control device 22. By ejecting the ink onto the medium 12 while the transport mechanism 24 transports the medium 12, the liquid election heads 100 form a desired image on the surface of the medium 12. Note that a direction perpendicular to an X-Y plane (a plane parallel to the surface of, for example, the medium 12) will be referred to as a Z direction hereinafter. A direction in which the liquid ejection heads 100 eject the ink (for example, downward in a vertical direction) corresponds to the Z direction.

Figure 2:
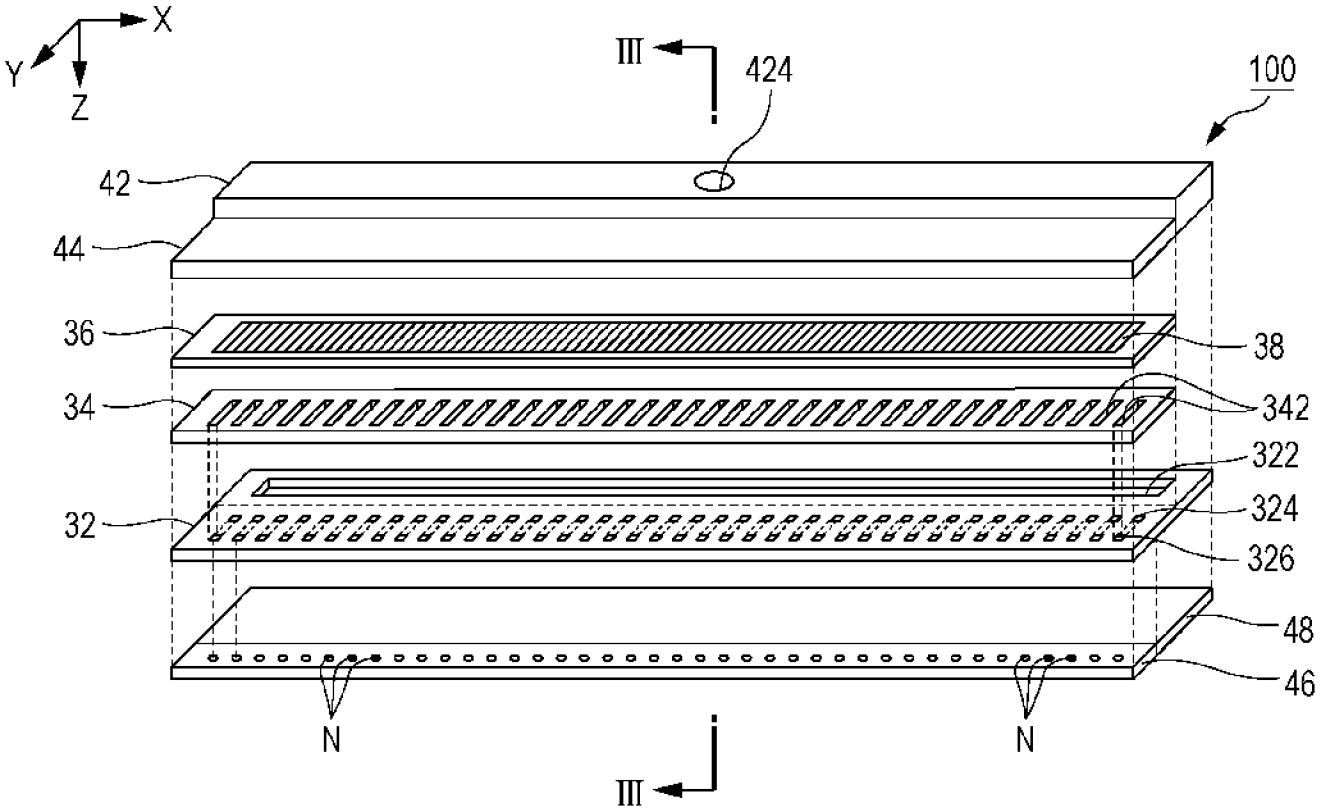
FIG. 2 is an exploded perspective view of a liquid ejection head.
Figure 3:
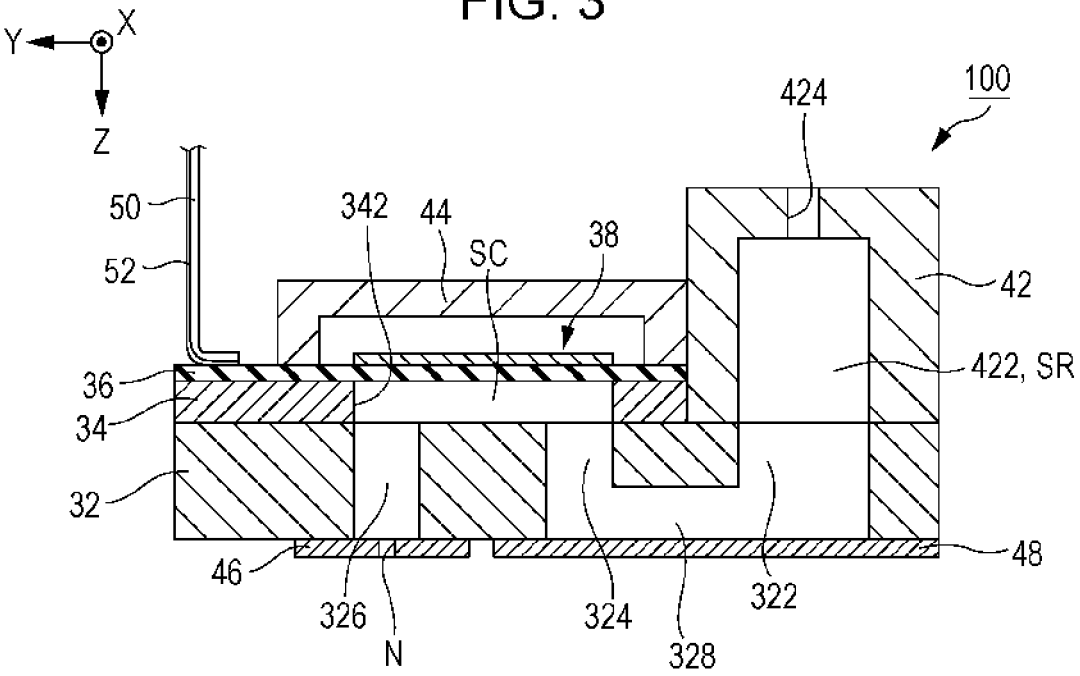
FIG. 3 is a cross-sectional view of the liquid ejection head, taken along the line III-III of FIG. 2.

FIG. 2 is an exploded perspective view of one of the liquid ejection heads 100; and FIG. 3 is a cross-sectional view taken along the line III-III of FIG. 2, which is parallel to the Y-Z plane. As exemplified in FIGS. 2 and 3, each of the liquid ejection heads 100 according to the first embodiment is a structure in which a pressure chamber substrate 34, a vibration portion 36, a plurality of piezoelectric elements 38, a housing 42, and a sealing member 44 are disposed on a flow path substrate 32 at a negative side in the Z direction, and a nozzle plate 46 and a compliance portion 48 are disposed on the flow path substrate 32 at a positive side in the Z direction. Schematically, the components of the liquid ejection heads 100 are members each having a substantially planar shape extending in the X direction and are mutually bonded, for example, with an adhesive agent.

The nozzle plate 46 is a planar plate in which a plurality of nozzles (ejection holes) N are arranged in the X direction, and is fixed to the flow path substrate 32 at the positive side in the Z direction, for example, with an adhesive agent. Each of the nozzles N is a through hole through which the ink passes.

The flow path substrate 32 is a planar plate in which flow paths for the ink are formed. As exemplified FIGS. 2 and 3, an opening 322, supply flow paths 324, and communication flow paths 326 are formed in the flow path substrate 32 according to the first embodiment. As exemplified in FIG. 2, the opening 322 is an opening that extends alongside the plurality of nozzles N in the X direction in a plan view (that is, when viewed in the Z direction). Meanwhile, the supply flow paths 324 and the communication flow paths 326 are through holes that are formed so as to be associated with respective nozzles N. As exemplified in FIG. 3, a groove-shaped branch flow path (manifold) 328 extending in the Y direction is formed for each of the supply flow paths 324 so as to allow the relevant supply flow path 324 to communicate with the opening 322 on the flow path substrate 32 at the positive side in the Z direction (a side opposite to the side of the pressure chamber substrate 34).

The housing 42 is a structure that is integrally molded by injection molding of, for example, a resin material, and is fixed to the flow path substrate 32 at the negative side in the Z direction. As exemplified in FIG. 3, the housing 42 according to this first embodiment has a container portion 422 and an introduction hole 424. The container portion 422 is a hollow structure whose inside diameter corresponds to the diameter of the opening 322 of the flow path substrate 32; and the introduction hole 424 is a through hole that communicates with the container portion 422. As understood from FIG. 3, a space resulting from allowing the opening 322 of the flow path substrate 32 and the container portion 422 of the housing 42 to communicate with each other functions as a liquid storage chamber (reservoir) SR. The ink supplied from the liquid container 14 passes through the introduction hole 424, and then is stored in the liquid storage chamber SR.

The compliance portion 48 shown in FIGS. 2 and 3 is a component for cancelling pressure fluctuation in the liquid storage chamber SR, and includes, for example, a flexible sheet member capable of being elastically deformed. Specifically, the compliance portion 48 is disposed on the flow path substrate 32 at the positive side in the Z direction so as to be a wall plate (specifically, a bottom plate) of the liquid storage chamber SR, which allows a liquid to be flowed through the opening 322, the branch flow paths 328, and the individual supply flow paths 324 in the flow path substrate 32. Accordingly, an ink flow path is formed for each of the nozzles N so as to branch from the liquid storage chamber SR to respective branch flow paths 328 and then come to a corresponding one of the supply flow paths 324.

As exemplified in FIGS. 2 and 3, the pressure chamber substrate 34 is a planar plate in which a plurality of openings 342, each of which is to be a pressure chamber (cavity) SC described below, are arranged in the X direction. The openings 324 are long-shaped through holes each extending in the Y direction in a plan view. Edges, at the negative side in the Y direction, of the openings 342 overlap respective supply flow paths 324 of the flow path substrate 32 in a plan view, while edges, at the positive side in Y direction, of the openings 342 overlap respective communication flow paths 326 of the flow path substrate 32 in a plan view. Materials and methods for manufacturing the flow path substrate 32 and the pressure chamber substrate 34 are not limited, and it is possible to easily and highly accurately form the flow path substrate 32 and the pressure chamber substrate 34 having desired shapes by selectively removing parts of a single-crystal Si substrate and the like, by using a semiconductor manufacturing process such as an etching process.

As exemplified in FIGS. 2 and 3, the vibration portion 36 is fixed onto a surface of the pressure chamber substrate 34, this surface of the pressure chamber substrate 34 being a surface opposite its surface facing the flow path substrate 32. The vibration portion 36 is a planar plate (vibration plate) capable of elastically vibrating. The vibration portion 36 can be formed by layer stacking an elastic film formed of an elastic material, such as an oxide silicon ($SiO_2$) material, and an insulating film made of an insulating material, such as a zirconium oxide ($ZrO_2$) material. In addition, although, in FIGS. 2 and 3, an example in which the vibration portion 36 that is formed separately from the pressure chamber substrate 34 is fixed to the pressure chamber substrate 34 is shown, the pressure chamber substrate 34 and the vibration portion 36 can be formed integrally with each other by selectively removing a plate-thickness direction portion constituting a planar plate for the pressure chamber substrate 34 and the vibration portion 36 and corresponding to the opening 342. As understood from the above description, the pressure chamber substrate 34 functions as a component that supports the vibration portion 36 so as to allow the vibration portion 36 to be capable of vibrating.

As understood from FIG. 3, the vibration portion 36 and the flow path substrate 32 faces each other so as to be distanced from each other inside each of the openings 34 of the pressure chamber substrate 342. A space that is located between the flow path substrate 32 and the vibration portion 36 inside each of the openings 342 functions as the pressure chamber SC that applies pressure to ink that is filled in the relevant space. The pressure chamber SC is individually formed for each of the nozzles N. As understood from the above description, the pressure chamber SC is a long-shaped space extending in the Y direction, and the vibration portion 36 constitutes a wall (specifically, an upper face) of the pressure chamber SC. The ink stored in the liquid storage chamber SR branches to the plurality of branch flow paths 328; passes through the supply flow paths 324; and, as a result, is concurrently supplied to and filled in the individual pressure chambers SC. Thereafter, for each of the pressure chambers SC, when a variation of pressure of the relevant pressure chamber SC occurs in response to a vibration of the vibration portion 36 corresponding to the relevant pressure chamber SC, a partial one of the ink filled in the relevant pressure chamber SC passes through the communication flow path 326 and the nozzle N, which correspond to the relevant pressure chamber SC, and then is ejected to the outside.

As exemplified in FIGS. 2 and 3, the plurality of piezoelectric elements 38 each associated with a corresponding one of the mutually different nozzles N (pressure chambers SC) are disposed on a face of the vibration portion 36, this face of the vibration portion 36 being a face opposite its face facing the pressure chamber SC (the pressure chamber substrate 34). The piezoelectric elements 38 are passive elements each of which vibrates by being supplied with a driving voltage, and are arranged in the X direction so as to be each associated with a corresponding one of the pressure chambers SC. The sealing member 44 shown in FIGS. 2 and 3 is a structural object for protecting the individual piezoelectric elements 38 and further strengthening the mechanical strengths of the pressure chamber substrate 34 and the vibration portion 36, and is fixed onto the surface of the vibration portion 36 by using, for example, an adherence agent. The plurality of piezoelectric elements 38 are contained in the inside of a concave portion that is formed at a face constituting the sealing member 44 and facing the vibration portion 36.

As exemplified in FIG. 3, a flexible wiring substrate 50, such as a flexible printed circuit (FPC), is fixed onto the surface of the vibration portion 36. The wiring substrate 50 includes a plurality of external wires 52 formed therein. The external wires 52 are wires for electrically connecting the liquid ejection heads 100 to external devices, such as the control device 22 and a power supply circuit (omitted from illustration).

Figure 4:
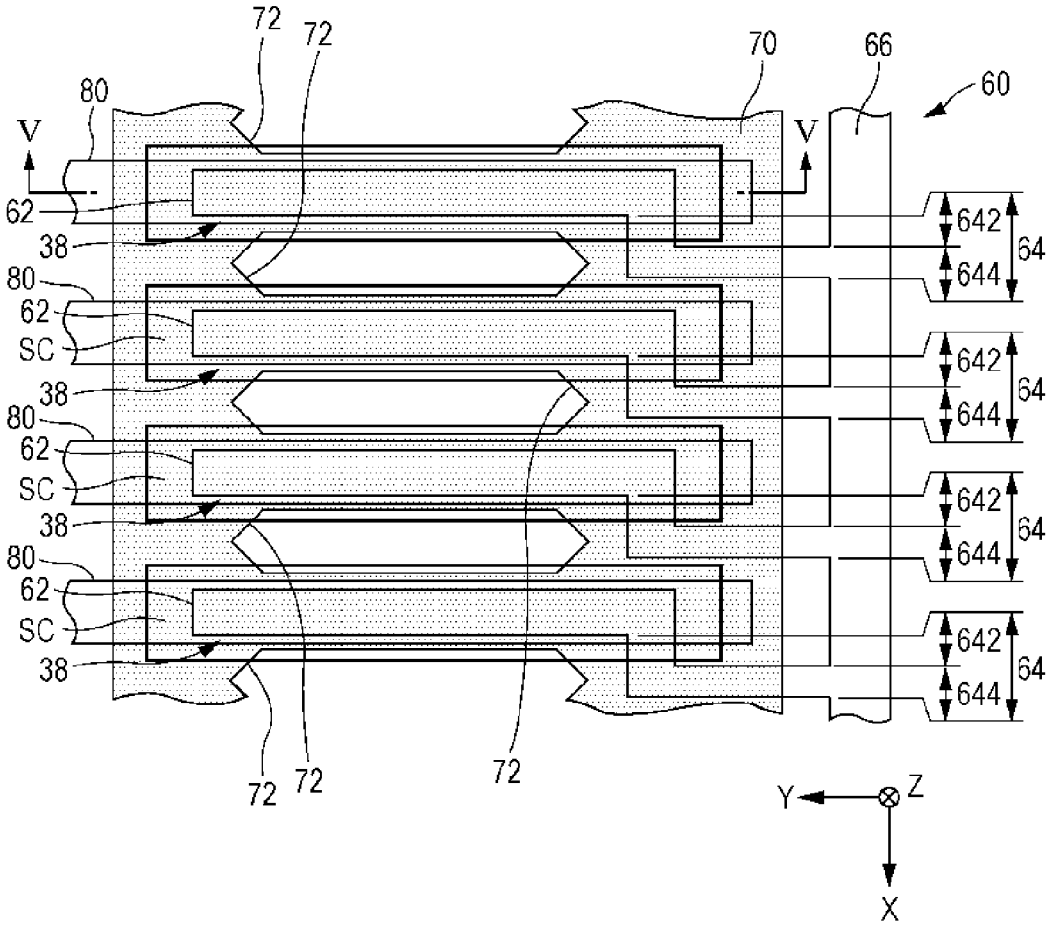
FIG. 4 is a plan view of a plurality of piezoelectric elements.
Figure 5:
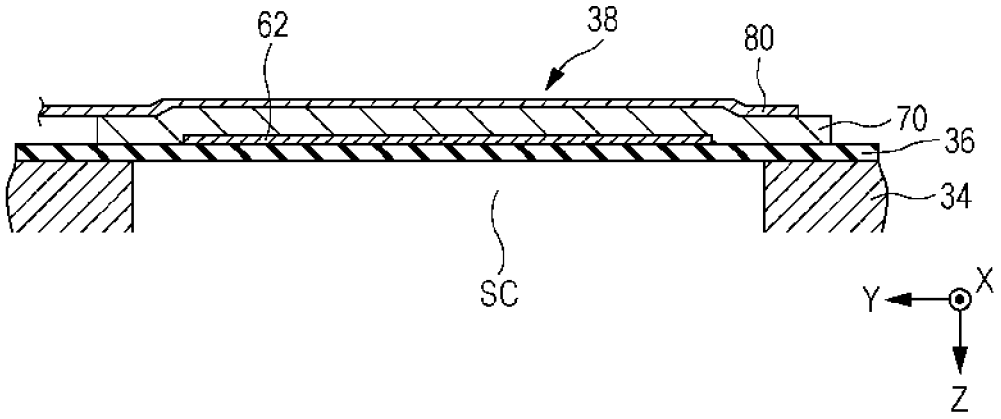
FIG. 5 is a cross-sectional view taken along the line V-V of FIG. 4.

A specific structure of the plurality of piezoelectric elements 38 will be described below in detail. FIG. 4 is a plan view of the plurality of piezoelectric elements 38; and FIG. 5 is a cross-sectional view taken along the line V-V of FIG. 4. In addition, in FIGS. 4 and 5, the sealing material 44 is omitted from illustration for the convenience of description.

As exemplified in FIG. 4, a conductive layer 60 is formed on the face of the vibration portion 36. The conductive layer 60 includes wiring patterns that are formed on the surface of the vibration portion 36 by using a conductive material. Although a material and a manufacturing method for the conductive layer 60 may be optionally employed, it is possible to form the conductive layer 60 by forming a thin film, which is made of, for example, a conductive material containing a platinum (Pt) material and having a low resistance, on the surface of the vibration portion 36 by means of a publicly known film formation technique, such as a spattering technique, and selectively removing the relevant thin film by using a process, such as a photolithographic process or an etching process. As exemplified in FIG. 4, the conductive layer 60 according to this first embodiment includes a plurality of pairs of a first electrode 62 and a wiring portion 64, each of the pairs being formed so as to be associated with a corresponding one of the plurality of pressure chambers SC (piezoelectric elements 38). Further, the conductive layer 60 also includes a common wire 66 that is formed across the plurality of piezoelectric elements 38.

The first electrode 62 is an individual band-shaped electrode extending in the Y direction and being individually formed for each of the piezoelectric elements 38. As exemplified in FIGS. 4 and 5, a plurality of the first electrodes 62 each associated with a corresponding one of the plurality of mutually different pressure chambers SC are arranged in the X direction so as to be distanced from one another and be each associated with an arrangement of a corresponding one of the plurality of pressure chambers SC. The first electrode 62 according to this first embodiment is formed in the inside of the pressure chamber SC in a plan view. That is, the peripheral edge of the first electrodes 62 is located inside the inner peripheral edge of the pressure chambers SC in a plan view.

The common wire 66 is wiring that is formed across the plurality of piezoelectric elements 38 and extends in the X direction. Specifically, the common wire 66 is formed at the negative side in the Y direction of the plurality of pressure chambers SC. The common wire 66 is electrically connected to the external wires 52 of the wiring substrate 50. As understood from the above description, the plurality of first electrodes 62 are electrically connected to the external wires 52 via the common wire 66 and the wiring portions 64. That is, the relevant wiring portion 64 functions as wiring for electrically connecting the relevant first electrode 62 (consequently, a corresponding piezoelectric element 38) to one of the external wires 52. For example, a predetermined reference voltage that is supplied from an external device via the external wires 52 is supplied to the plurality of first electrodes 62 via the common wire 66 and the respective wiring portions 64.

Figure 6:
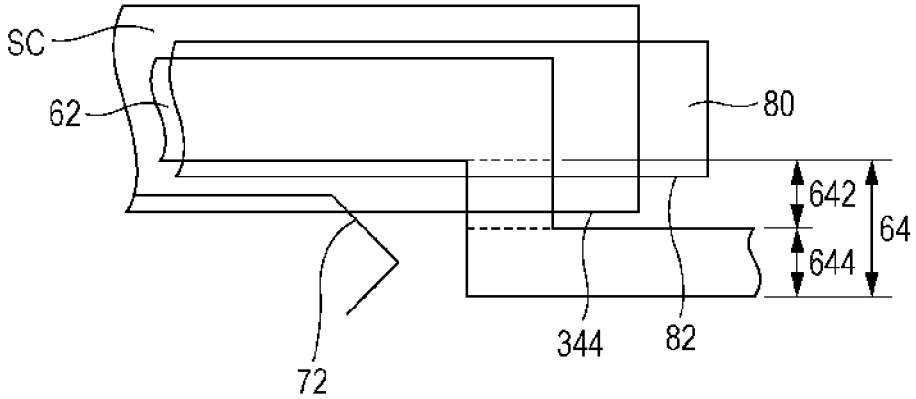
FIG. 6 is an enlarged plan view of one of wiring portions.

FIG. 6 is an enlarged plan view of one of the wiring portions 64. As exemplified in FIGS. 4 and 6, the wiring portion 64 according to this first embodiment includes an extracting portion 642 and a relay wire 644. The extracting portion 642 is electrically connected to the first electrode 62, and the relay wire 644 interconnects the extracting portion 642 and the common wire 66. Specifically, the extracting portion 642 protrudes toward a positive side in the X direction from a peripheral edge of the first electrode 62 extending in the Y direction (that is, from a long side of the first electrode 62) in a plan view.

As understood from FIG. 6, the extracting portion 642 is formed so as to cross a long side 344 of the inner peripheral edge of the pressure chamber SC and extending in the Y direction in a plan view. That is, the extracting portion 642 crosses from the inside of the pressure chamber SC to the outside thereof across the long side 344 of the pressure chamber SC and then continues, in a plan view. As understood from the above description, in this first embodiment, the wiring portion 54 for electrically connecting the first electrode 62 to the external wires 52 does not cross any short side constituting the inner peripheral edge of the pressure chamber SC and extending in the X direction (that is, any end portion of the pressure chamber SC).

As exemplified in FIGS. 4 and 6, the relay wires 644 extend in a band shape in the Y direction from edges of the extracting portions 642, these edges being located outside the pressure chamber SC, and further, edges of the relay wires 644, edges of the relay wires 644 being edges opposite the extracting portions 642, are electrically connected to the common wire 66. The relay wires 644 according to this first embodiment are located outside the pressure chamber SC (specifically, between a pair of pressure chambers SC that are arranged adjacent to each other in the X direction). As understood from the above description, each of the plurality of wiring portions 64 that are branched from the common wire 66 is electrically connected to a corresponding one of the first electrodes 62.

As exemplified in FIGS. 4 and 5, a piezoelectric material layer 70 is formed on the face of the vibration portion 36 on which the conductive layer 60 having been exemplified above is formed. In FIG. 4, half-tone dot meshing is applied to the piezoelectric material layer 70 for the convenience of description. Although a material and a manufacturing method for the piezoelectric material layer 70 may be optionally employed, it is possible to form the piezoelectric material layer 70 by forming a film from a piezoelectric material, such as a lead zirconate titanate material, by means of a publicly known film formation technique, such as a spattering technique. The piezoelectric material layer 70 is formed of such a piezoelectric material, and coats the plurality of first electrodes 62. The piezoelectric material layer 70 according to this first embodiment extends in the X direction so as to continue across the plurality of pressure chambers SC in a plan view. Specifically, the piezoelectric material layer 70 is formed in a band shape whose lateral width is larger than the overall Y direction length of the pressure chamber SC. That is, the plurality of pressure chambers SC is included in the inside of a region formed of the piezoelectric material layer 70 in a plan view.

As exemplified in FIG. 4, in the piezoelectric material layer 70, one of slits 72 each having a long shape in the Y direction is formed at a position in a space between every pair of two mutually adjacent ones of the first electrodes 62. Each of the slits 72 is a through hole or a bottomed hole, which is formed in the piezoelectric material layer 70, and is a portion whose rigidity is made lower than any other portion of the piezoelectric material layer 70. As understood from FIGS. 4 and 6, the wiring portion 64 is located at one side in the Y direction when viewed from the slit 72 in a plan view. Specifically, the wiring portion 64 according to this first embodiment is formed at a negative direction side in the Y direction when viewed from the slit 72 (that is, at a side of the common wire 66). That is, the wiring portion 64 (which is constituted by the extracting portion 642 and the relay wire 644) is located between the slit 72 and the common wire 66. Accordingly, there is an advantage in that, as compared with, for example, a configuration in which the extracting portion 642 is formed at the opposite side of the slit 72 from the common wire 66, the wiring length (consequently, the electric resistance) of the wiring portion 64 is made smaller. In this regard, however, it is also possible to employ a configuration in which the slits 72 are omitted (that is, the piezoelectric material layer 70 continues in a band shape across the plurality of piezoelectric elements 38), or a configuration in which a piezoelectric material layer 70 is individually formed for each of the piezoelectric elements 38 so as to be distanced from each of two piezoelectric material layers 70 that are adjacent to the relevant piezoelectric material layer 70.

As exemplified in FIGS. 4 and 5, a plurality of second electrodes 80 are formed on the piezoelectric material layer 70. The second electrodes 80 according to this first embodiment is an individual band-shaped electrode extending in the Y direction and being formed for each of the piezoelectric elements 38, and is formed of a conductive material having a low resistance just like the first electrode 62. Edges of the second electrodes 80 at a positive side in the Y direction (these edges are omitted in the drawings) are electrically connected to external wiring 52 of the wiring substrate 50. A driving voltage supplied from an external device is supplied to the second electrodes 80 via the external wiring 52.

As exemplified in FIG. 4, the plurality of second electrodes 80 each associated with a corresponding one of the mutually different pressure chambers SC are arranged in the X direction so as to be distanced from one another. The sizes and the positions of the respective first electrode 62 and second electrode 80 are selected such that the second electrode 80 includes the first electrode 62 in the inside of the second electrode 80 in a plan view. Specifically, as exemplified in FIG. 4, the wiring width of the first electrode 62 is smaller than that of the second electrode 80, and the first electrode 62 is formed between a pair of long sides of the second electrode 80. As understood from the above description, the first electrode 62 according to this first embodiment has a planar shape included in the inside of the second electrode 80 and is formed inside the pressure chamber SC in a plan view. As understood from FIG. 6, the extracting portion 642 of the wiring portion 64 is formed so as to cross a long side 82 constituting a peripheral edge of the second electrode 80 and extending in the Y direction in a plan view.

As exemplified in FIG. 5, the piezoelectric material layer 70 is sandwiched by the first electrode 62 and the second electrode 80. A region resulting from overlapping the first electrode 62 and the second electrode 80 in a plan view in a state in which the piezoelectric material layer 70 is sandwiched thereby corresponds to the piezoelectric element 38. That is, the plurality of piezoelectric elements 38, each of which is constituted by stacked layers of the first electrode (lower electrode) 62, the piezoelectric material layer 70, and the second electrode (upper electrode) 80, are arranged in the X direction on the face of the vibration portion 36 so as to be distanced from one another. For each of the piezoelectric elements 38, the piezoelectric material layer 70 of the relevant piezoelectric elements 38 is displaced by electric field behavior in accordance with a voltage difference between a reference voltage that is supplied from an external device to the first electrode 62 via the external wires 52, the common wire 66, and the wiring portion 64 and a driving signal that is supplied from an external device to the second electrode 80 via the external wires 52. Further, a variation of pressure inside the pressure chamber SC due to a vibration of the vibration portion 36 in conjunction with the displacement of the piezoelectric material layer 70 causes a partial one of the ink filled in the pressure chamber SC to pass through the communication flow path 326 and be ejected to the outside through the nozzle N. Since, in the piezoelectric material layer 70, the slit 72 is formed in a space between every two mutually adjacent ones of the piezoelectric elements 38, and thus, vibration propagation across between any two ones of the plurality of piezoelectric elements 38 is suppressed.

In this first embodiment, since the first electrode 62 is formed in a shape of being included in the inside of the second electrode 80 in a plan view, a movable portion that is included in the piezoelectric material layer 70 and that is displaced by the electric field behavior between the first electrode 62 and the second electrode 80 is defined by the planar shape of the first electrode 62. That is, a portion constituting the piezoelectric material layer 70 and overlapping the first electrode 62 in a plan view functions as the movable portion. Further, since the first electrode 62 is formed inside the second electrode 80 in a plan view, each of the movable portions according to this first embodiment is located inside a corresponding one of the pressure chambers SC in a plan view.

Further, significantly large stress is likely to arise at the boundary between the movable portion and a non-movable portion, which is a portion other than the movable portion, in the piezoelectric material layer 70. Meanwhile, a region constituting the vibration portion 36 and being close to the long side 344 of the pressure chamber SC is more likely to be deformed as compared with a region close to a short side of the pressure chamber SC. In this first embodiment, since the extracting portion 642, which electrically connects the piezoelectric element 38 (the first electrode 62) to one of the external wires 52, is formed so as to cross the long side 344 of the pressure chamber SC (that is, a region where the vibration portion 36 is likely to be deformed) in a plan view, stress that arises in a region constituting the piezoelectric material layer 70 and corresponding to the extracting portion 642 is more likely to be absorbed or dispersed, as compared with a configuration, just like the configuration disclosed in JP-A-2014-83797, in which the first electrode 62 is formed so as to cross a short side of the pressure chamber SC in a plan view, and as a result, there is an advantage in that the breakage of the piezoelectric material layer 70 can be prevented.

By the way, in a configuration in which a portion of the first electrode 62 does not overlap the second electrode 80 in a plan view, a region constituting the piezoelectric material layer 70 and corresponding to the relevant portion of the first electrode 62 does not function as the movable portion. For example, in a configuration shown in FIG. 26 of Japanese Patent No. 3,114,808, since a removed portion (cutout) in which a lower electrode film is partially removed does not overlap an upper electrode film, a movable portion has a planar shape (concave shape) in which a cutout (non-movable portion) corresponding to the removed portion is formed. In the configuration of this first embodiment, the first electrode 62 is included in the inside of the second electrode 80 in a plan view (that is, the entire region of the first electrode 62 having a substantially rectangular shape overlaps the first electrode 62), and thus, a movable portion having a shape across the entire region of the first electrode 62 in a plan view is defined. According to this first embodiment, as described above, an area of the movable portion can be sufficiently secured, and thus, there is an advantage in that it becomes easier to vibrate the vibration portion 36.

Second Embodiment

A second embodiment according to the invention will be described below. In addition, in each of embodiments exemplified below, any constituent element whose operation or function is similar to that of a constituent element of the first embodiment will be denoted by a reference sign having been used therefor in the description of the first embodiment, and detailed description thereof will be appropriately omitted.

Figure 7:
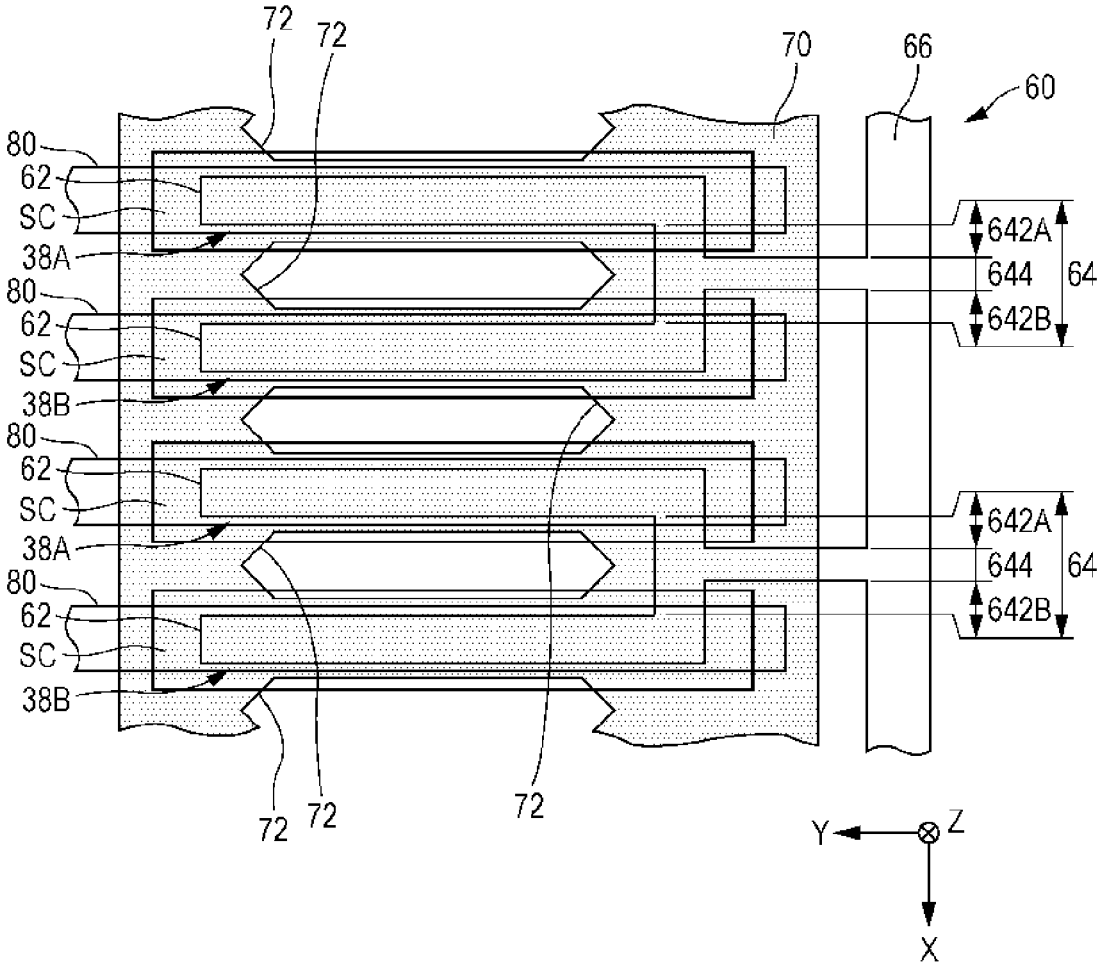
FIG. 7 is a plan view of a plurality of piezoelectric elements according to a second embodiment of the invention.

FIG. 7 is a plan view of a plurality of piezoelectric elements 38 in the second embodiment. In the first embodiment, the wiring portion 64 is formed for each of the piezoelectric elements 38. As exemplified in FIG. 7, a conductive layer 60 according to this second embodiment includes a wiring portion 64 for each pair of two piezoelectric elements 38 (first piezoelectric element 38A and a second piezoelectric element 38B) that are arranged adjacent to each other in the X direction. That is, there are formed the wiring portions 64 whose number corresponds to half the total number of the piezoelectric elements 38. The first piezoelectric element 38A is, for example, an odd number-th one of the piezoelectric elements 38; and the second piezoelectric element 38B is, for example, an even number-th one of the piezoelectric elements 38. In addition, a configuration in which a first electrode 62 is individually formed for each of the piezoelectric elements 38 and a configuration in which a common wire 60 is formed across the plurality of piezoelectric elements 38 are similar to those of the first embodiment.

As exemplified in FIG. 7, each of the wiring portions 64 includes an extracting portion 642A associated with a corresponding first piezoelectric element 38A; an extracting portion 642B associated with a corresponding second piezoelectric element 38B; and one relay wire 644. The extracting portion 642A protrudes toward a positive side in the X direction from a long side of a first electrode 62 of the relevant first piezoelectric element 38A (that is, from an edge at a positive side of the first electrode 62 in the X direction), and is formed in a planar shape that crosses a positive side in the X direction of a long side of a pressure chamber SC corresponding to the relevant first piezoelectric element 38A. The extracting portion 642B protrudes toward a negative side in the X direction from a long side of a first electrode 62 of the relevant second piezoelectric element 38B (that is, from an edge at a negative side of the first electrode 62 in the X direction), and is formed in a planar shape that crosses a negative side in the X direction of a long side of a pressure chamber SC corresponding to the relevant second piezoelectric element 38B.

Relay wires 64 each corresponding to a pair of two adjacent ones of the piezoelectric elements 38 extend in the Y direction between a first piezoelectric element 38A and a second piezoelectric element 38B that constitute the relevant pair. Further, as exemplified in FIG. 7, an extracting portion 642A of the relevant first piezoelectric element 38A and an extracting portion 642B of the relevant second piezoelectric element 38B are electrically connected in common to the respective relay wires 644 corresponding to the relevant pair. That is, a first electrode 62 of the relevant piezoelectric element 38A and a first electrode 62 of the relevant second piezoelectric element 38B are electrically connected to a common wire 66 via the relevant relay wires 644 that is common to the relevant piezoelectric elements 38A and 38B. As understood from the above description, in this second embodiment, for the use of supply of a reference voltage to the first piezoelectric element 38A and the second piezoelectric element 38B, one of the relay wires 644 is provided in common thereto.

In this second embodiment, an advantageous effect similar to that of the first embodiment is brought about. Further, in this second embodiment, since the extracting portions 642 of the respective two adjacent piezoelectric elements 38 constituting a pair (that is, the first piezoelectric element 38A and the second piezoelectric element 38B) are electrically connected in common to the relay wires 644 corresponding to the relevant pair, there is an advantage in that a space required to form wires is made smaller, as compared with a configuration (for example, the configuration of the first embodiment) in which each of the relay wires 644 is individually formed for each of the piezoelectric elements 38.

Third Embodiment

Figure 8:
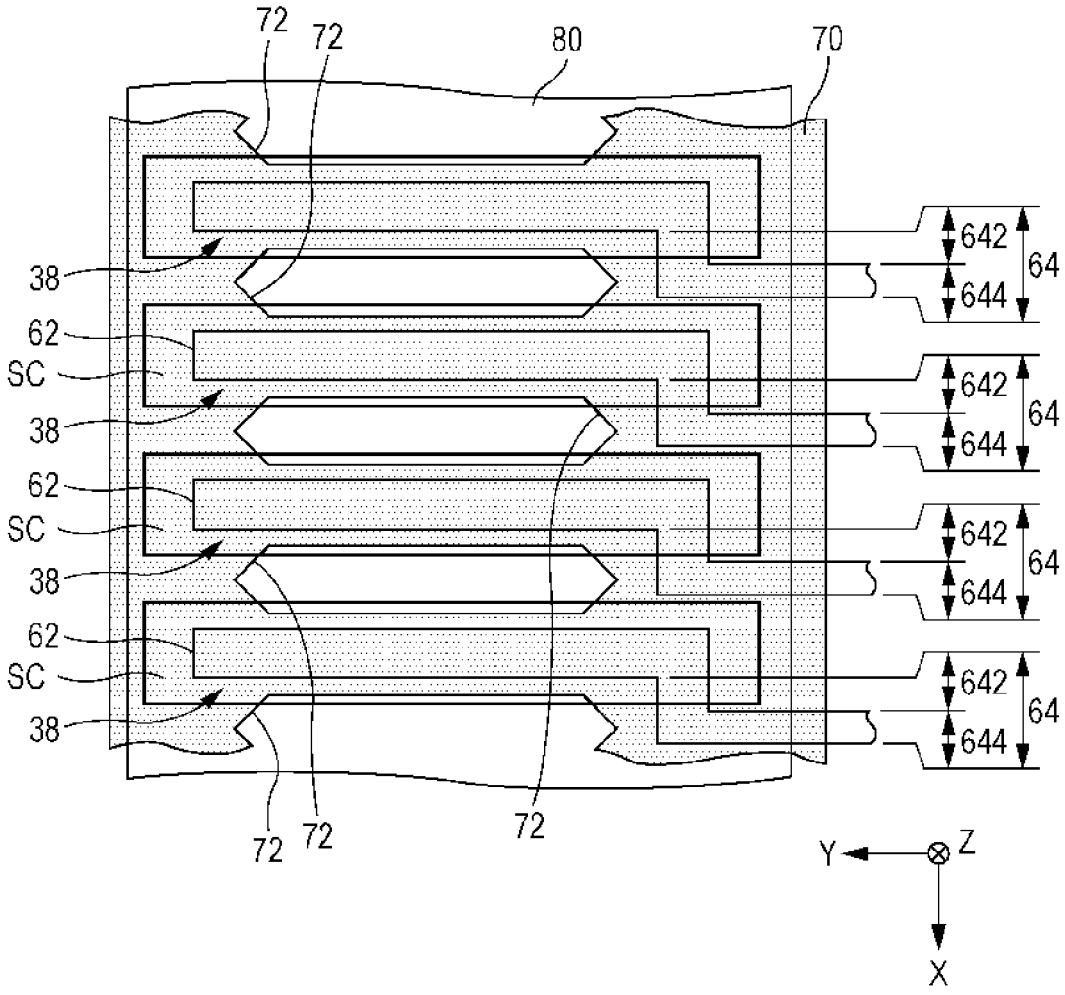
FIG. 8 is a plan view of a plurality of piezoelectric elements according to a third embodiment of the invention.

FIG. 8 is a plan view of a plurality of piezoelectric elements 38 in the third embodiment. In the first embodiment, the configuration in which both of the first electrode 62 and the second electrode 80 are made individual electrodes for each of the piezoelectric elements 38 has been exemplified. As exemplified in FIG. 8, a second electrode 80 according to this third embodiment is a common electrode that continues across the plurality of piezoelectric elements 38. Specifically, the second electrode 80 according to this third embodiment has a lateral width smaller than that of a piezoelectric material layer 70 and extends in a band shape in the Y direction. A configuration in which a first electrode 62 is individually formed for each of the piezoelectric elements 38 is similar to the configuration of the first embodiment. In this regard, however, the common wire 66 of the first embodiment is omitted, and a driving voltage that is supplied from an external device to the piezoelectric elements 38 via external wires 52 is supplied to a plurality of the first electrode 62 via wiring portions 64; while a reference voltage is supplied to the second electrodes 80 from the external device via the external wires 52.

In this third embodiment, an advantageous effect similar to that of the first embodiment is also brought about. Further, in this third embodiment, since the second electrode 80 is formed so as to continue across the plurality of piezoelectric elements 38, there is an advantage in that a process of forming the second electrode 80 is made simpler and the resistance of the second electrode 80 is made smaller, as compared with a configuration (for example, the configuration of the first embodiment) in which the second electrode 80 is individually formed for each of the piezoelectric elements 38.

Modification Examples

The individual embodiments having been exemplified above can be variously modified. Specific modified embodiments will be exemplified below. Two or more modified embodiments that are optionally selected from the following specific modified embodiments can be appropriately combined within a scope in which the modified embodiments to be selected are not contradictory to one another.

Figure 9:
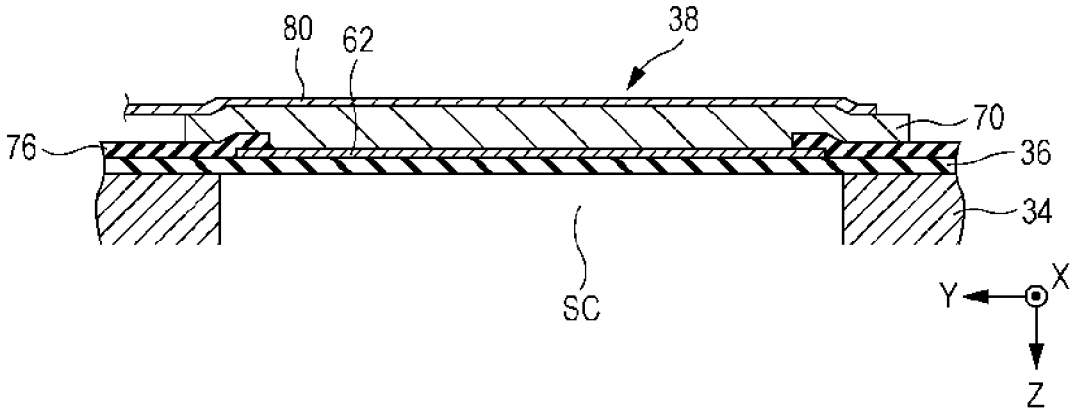
FIG. 9 is a cross-sectional view of a piezoelectric element in a modified embodiment of the invention.

(1) An insulating layer can be formed between the first electrode 62 and the second electrode 80. For example, in FIG. 9, a configuration in which an insulating layer 76 that extends over the plurality of piezoelectric elements 38 is formed between the first electrodes 62 and the piezoelectric material layer 70 is exemplified. The insulating layer 76 is formed of a film made of an insulating material, such as a zirconium oxide material, and includes openings each of which is formed so as to be associated with a corresponding one of the piezoelectric elements 38. In the piezoelectric material layer 70, regions in each of which the insulating layer 76 is interposed between a corresponding one of the first electrodes 62 and the piezoelectric material layer 70 are not deformed, and thus, in the configuration shown in FIG. 9, each of movable portions in the piezoelectric material layer 70 is defined by a corresponding one of the openings of the insulating layer 76. In addition, in substitution for (or together with) the configuration shown in FIG. 9, in which the insulating film 76 is formed between the first electrodes 62 and the piezoelectric material layer 70, it is also possible to form an insulating film similar to the insulating film 76 between the piezoelectric material layer 70 and the second electrodes 80.

(2) In the first embodiment, both of the first electrode 62 and the second electrode 80 are formed as individual electrodes for each of the piezoelectric elements 38; a common reference voltage is supplied to each of the first electrode 62; and a driving voltage is individually supplied to each of the second electrodes 80. In such a configuration of the first embodiment, it is also possible to omit the common wire 66; supply an individual driving voltage to each of the first electrodes 62; and supply a common reference voltage to the plurality of second electrodes 80.

Figure 10:
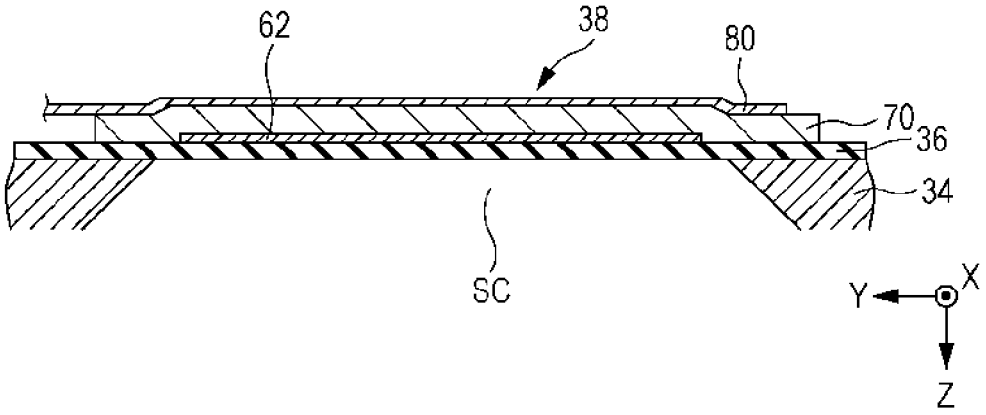
FIG. 10 is a cross-sectional view of a piezoelectric element in a modified embodiment of the invention.

(3) In the individual embodiments described above, the configuration in which the inner peripheral faces of the pressure chamber SC are parallel to the Z direction has been exemplified, but, as exemplified in FIG. 10, it is also possible to employ a configuration in which the inner peripheral faces of the pressure chamber SC are made faces that are inclined relative to the X-Y plane. That is, the pressure chamber SC exemplified in FIG. 10 is a space whose cross-sectional area decreases as the position of the relevant cross section comes near the vibration portion 36 (the piezoelectric element 38).

Figure 11:
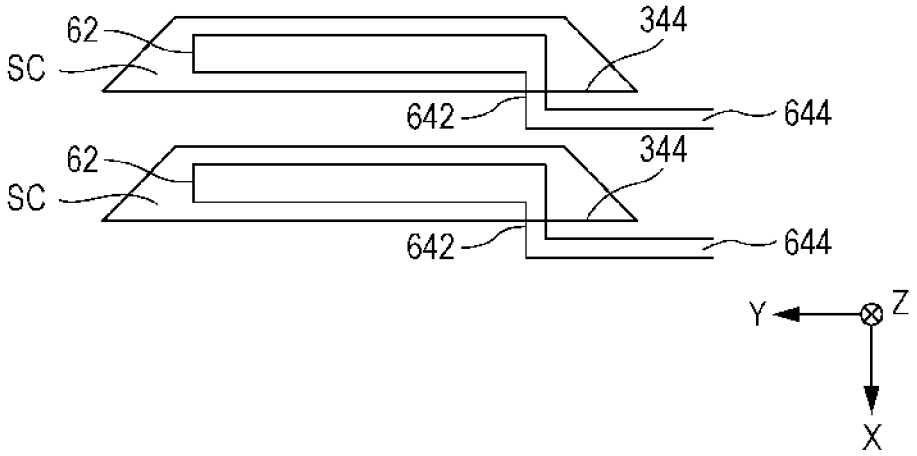
FIG. 11 is a plan view of a pressure chamber in a modified embodiment of the invention.
Figure 12:
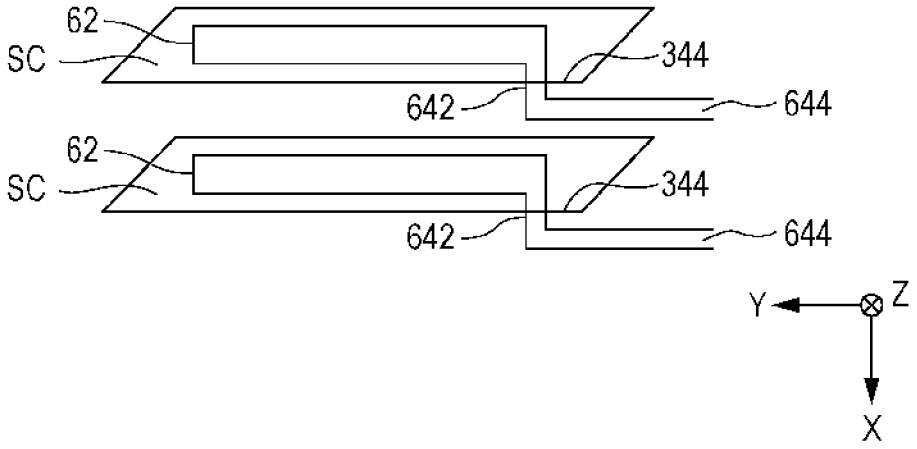
FIG. 12 is a plan view of a pressure chamber in a modified embodiment of the invention.
Figure 13:
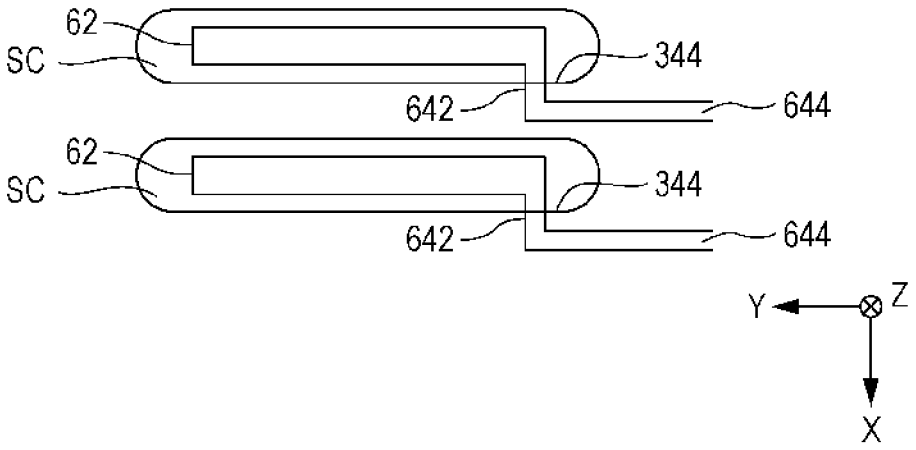
FIG. 13 is a plan view of a pressure chamber in a modified embodiment of the invention.
Figure 14:
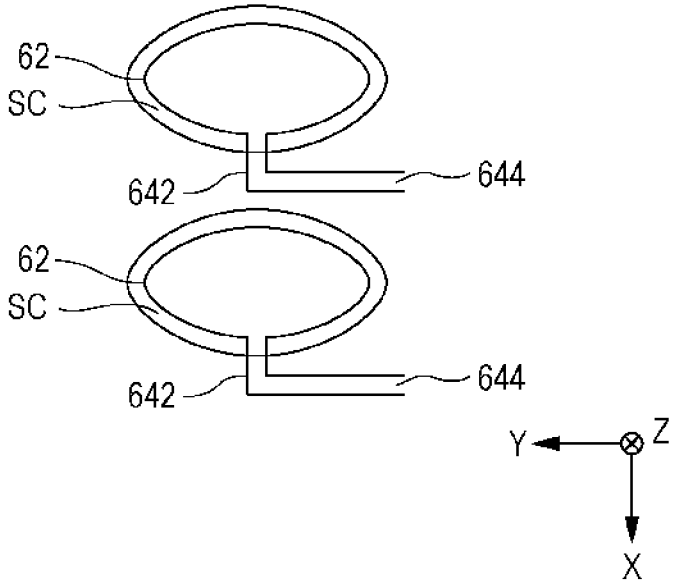
FIG. 14 is a plan view of a pressure chamber in a modified embodiment of the invention.

(4) The planar shapes of the pressure chamber SC and the piezoelectric element 38 are not limited to the exemplifications (the rectangular shapes) in each of the embodiments described above. For example, in a configuration in which a silicon single crystal substrate is used as the pressure chamber substrate 34, actually, the planar shape of the pressure chamber SC may be determined by a crystal plane. For example, it is possible to form a pressure chamber SC whose planar shape forms a trapezoidal shape exemplified in FIG. 11 or a parallelogram shape exemplified in FIG. 12. Further, it is also possible to form a pressure chamber SC whose planar shape forms an outline including a curved line. For example, it is possible to form a pressure chamber SC whose planar shape forms an elongated circular shape exemplified in FIG. 13 or an oval shape (egg shape or elliptical shape) exemplified in FIG. 14. As understood from the above exemplifications, the extracting portion 642 is formed so as to cross a long side of the inner peripheral edge of the pressure chamber SC and extending in a longitudinal direction of the relevant pressure chamber SC (that is, in the Y direction in the individual embodiments exemplified above), and it is unnecessary to take into consideration not only the planar shape of the inner peripheral edge of the pressure chamber SC, but also which of a direct line and a curved line forms the long side of the inner peripheral edge thereof.

Figure 15:
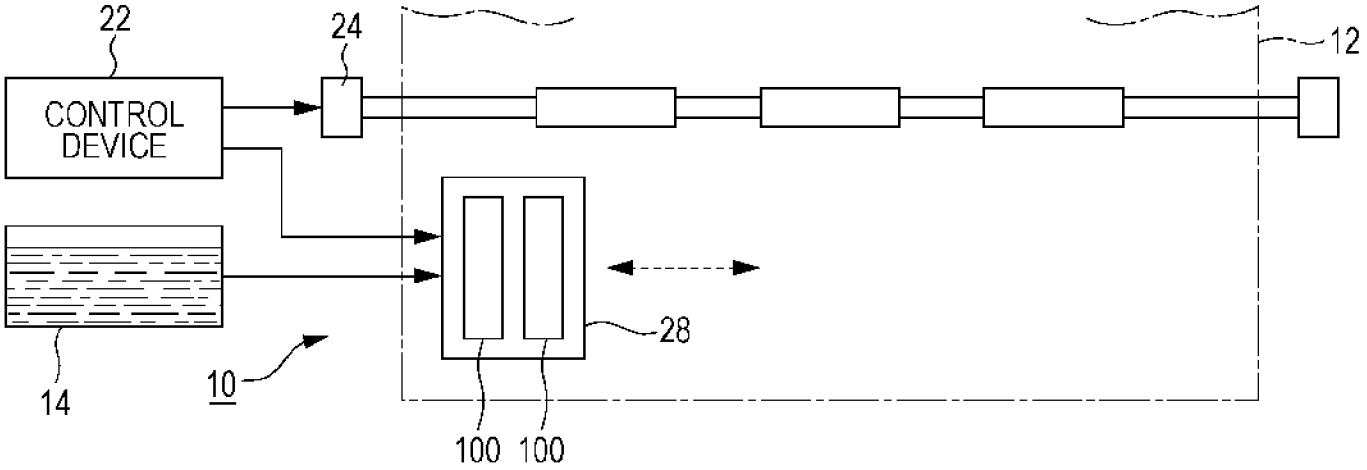
FIG. 15 is a diagram illustrating a configuration of a printing apparatus according to a modified embodiment of the invention.

(5) In the individual embodiments described above, the line head including the plurality of liquid ejection heads 100 that are arranged in the X direction perpendicular to the Y direction in which the medium 12 is transported has been exemplified, but the embodiment of the invention can be also applied to a serial head. For example, as exemplified in FIG. 15, the carriage 28 in which the plurality of ejection heads 100 according to the above individual embodiments is mounted reciprocates in the X direction under the control of the control device 22, and concurrently therewith, each of the liquid ejection heads 100 ejects ink onto the medium 12.

(6) The printing apparatus 10 having been exemplified in the above individual embodiments can be employed in, not only a device dedicated to printing, but also various devices, such as a facsimile machine and a copying machine. The intended use of a liquid ejection apparatus according to an aspect of the invention is not limited to printing. For example, a liquid ejection apparatus that ejects liquid solutions of color materials is utilized as a manufacturing apparatus for forming color filters for liquid crystal display apparatuses. Further, a liquid ejection apparatus that ejects liquid solutions of conductive materials is utilized as a manufacturing apparatus for forming wiring and electrodes for wiring substrates.

The present application claims priority to Japanese Patent Application No. 2015-015218 filed on Jan. 29, 2015, which is hereby incorporated by reference in its entirety.

What is claimed is:

1. A liquid ejection head comprising:

a vibration portion that serves as a wall of a pressure chamber having a shape extending in a first direction;

at least one piezoelectric element that is disposed on the vibration portion at an opposite side to the pressure chamber; and an extracting portion that electrically connects the piezoelectric element, wherein the piezoelectric element includes a first electrode, a second electrode, and a piezoelectric material layer between the first electrode and the second electrode, wherein, in a plan view, the first electrode has a planar shape that is included in shapes of the second electrode and the pressure chamber, and wherein, in a plan view, the extracting portion protrudes from a peripheral edge of the first electrode so as to cross a long side of an inner peripheral edge extending in the first direction of the pressure chamber; and the liquid ejection head further comprising:

a common wire;

a first relay wire that is electrically connected to the common wire; and a second relay wire that is electrically connected to the common wire, wherein the extracting portion includes i) a first extracting portion electrically connecting the first electrode extending in the first direction (+X direction) and electrically connecting the first relay wire, and ii) and a second extracting portion electrically connecting the another first electrode which is arranged to be adjacent to the first electrode extending in the first direction (+X direction) and electrically connecting the second relay wire.

2. The liquid ejection head according to claim 1, wherein the at least one piezoelectric element comprises a plurality of piezoelectric elements that are arranged in a second direction intersecting the first direction.

3. The liquid ejection head according to claim 2, wherein the first electrode and the second electrode are individual electrodes that are formed for each of the plurality of piezoelectric elements, and the first electrode that is formed for each of the plurality of piezoelectric elements is electrically connected to the common wire via the extracting portion.

4. A liquid ejection apparatus comprising the liquid ejection head according to claim 3.

5. The liquid ejection head according to claim 2, wherein the first electrode is an individual electrode that is individually formed for each of the plurality of piezoelectric elements, and the second electrode is a common electrode that extends over the plurality of piezoelectric elements.

6. A liquid ejection apparatus comprising the liquid ejection head according to claim 5.

7. A liquid ejection apparatus comprising the liquid ejection head according to claim 2.

8. A liquid ejection apparatus comprising the liquid ejection head according to claim 1.

9. A liquid ejection head comprising:

a vibration portion that serves as a wall of a pressure chamber having a shape extending in a first direction;

at least one piezoelectric element that is disposed on the vibration portion at an opposite side to the pressure chamber; and an extracting portion that electrically connects the piezoelectric element to external wiring, wherein the piezoelectric element includes a first electrode, a second electrode, and a piezoelectric material layer between the first electrode and the second electrode, wherein, in a plan view, the first electrode has a planar shape that is included in shapes of the second electrode and the pressure chamber, and wherein, in a plan view, the extracting portion protrudes from a peripheral edge of the first electrode so as to cross a long side of an inner peripheral edge extending in the first direction of the pressure chamber, and the liquid ejection head further comprising:

a common wire; and a relay wire that is electrically connected to the common wire, wherein the extracting portion includes i) a first extracting portion electrically connecting the first electrode extending in the first direction (+X direction) and electrically connecting the relay wire, and ii) and a second extracting portion electrically connecting the another first electrode which is arranged to be adjacent to the first electrode extending in the opposite direction of the first direction(−X direction) and electrically connecting the relay wire.

10. A liquid ejection apparatus comprising the liquid ejection head according to claim 9.

11. A liquid ejection head comprising:

a vibration portion that serves as a wall of a pressure chamber having a shape extending in a first direction;

at least one piezoelectric element that is disposed on the vibration portion at an opposite side to the pressure chamber; and an extracting portion that electrically connects the piezoelectric element, wherein the piezoelectric element includes a first electrode, a second electrode, and a piezoelectric material layer between the first electrode and the second electrode, wherein, in a plan view, the first electrode has a planar shape that is included in shapes of the second electrode and the pressure chamber, and wherein, in a plan view, the extracting portion protrudes from a peripheral edge of the first electrode so as to cross a long side of an inner peripheral edge extending in the first direction of the pressure chamber, the piezoelectric material layer extends and serves as the plurality of piezoelectric elements, the piezoelectric material layer covers a whole of the extracting portion.

12. The liquid ejection head according to claim 11, wherein a slit that is long in the first direction is formed between two adjacent piezoelectric elements of the plurality of piezoelectric elements arranged in a second direction intersecting the first direction, and wherein the extracting portion is disposed at one side of the slit in the first direction.

13. A liquid ejection apparatus comprising the liquid ejection head according to claim 12.

14. A liquid ejection apparatus comprising the liquid ejection head according to claim 11.

* * * * *